US005336853A

United States Patent [19]

Davidson

[11] Patent Number: 5,336,853

[45] Date of Patent: Aug. 9, 1994

[54] WEIGHING APPARATUS

[75] Inventor: Ian Davidson, Lutterworth, England

[73] Assignee: Bagfilla Overseas Limited, Lutterworth, England

[21] Appl. No.: 959,764

[22] Filed: Oct. 13, 1992

[30] Foreign Application Priority Data

Oct. 15, 1991 [GB] United Kingdom ..... 9121817.2

[51] Int. Cl.[5] ..... G01G 19/52

[52] U.S. Cl. ..... 177/146

[58] Field of Search ..... 177/146, 160

[56] References Cited

FOREIGN PATENT DOCUMENTS 2154975 9/1985 United Kingdom .

2178862 2/1987 United Kingdom .

*Primary Examiner*—George H. Miller, Jr.

*Attorney, Agent, or Firm*—Jones, Day, Reavis & Poque

[57] ABSTRACT

Weighing apparatus includes support means to support the article to be weighed, a pair of screws fixedly mounted on the support means and a base member movable relative to the screws between a first position in which the base member is spaced from the bottom of the article and a second position in which the base member is in contact with the article. Screw receiving members are threadably mounted on the screws and are connected to the base member. Upon rotation of the screw receiving members, the base member is moved between the first and second positions.

21 Claims, 2 Drawing Sheets

WEIGHING APPARATUS

This invention relates to weighing apparatus. Particularly, but not exclusively, the invention relates to weighing apparatus to be used in relation to bag filling apparatus.

A known bag weighing apparatus comprises a platform to provide support for the bottom of the bag as it is being filled. The platform is raised to contact the bottom of the bag by means of piston and cylinder devices. With different sizes of bag it is necessary to vary the position of the platform.

A disadvantage of such apparatus is that it is difficult to vary the position of the platform other than by altering the position at which the platform is connected to the piston and cylinder devices or by varying the position of the platform together with its operating piston and cylinder. This can be time consuming. Also, any imbalance in the action of the piston and cylinder devices could result in it being difficult to ensure that the platform rises horizontally and that it is horizontal when it is in contact with the bottom of the bag. In certain situations the base must support also certain components of automatic bag unloading apparatus. Piston and cylinder devices may be unable to support the additional load without expensive upgrading.

It is an object of the invention to obviate or mitigate these and other disadvantages.

According to this invention, there is provided weighing apparatus comprising support means to support the article to be weighed, a base member movable from a first position spaced from the bottom of the article to a second position in contact with the bottom of the article and a screw threaded arrangement to move the base member between the first and second positions.

Preferably, the screw threaded arrangement comprises first and second screws mounted on the support means at either side of the article to be weighed. The arrangement may also comprise first and second screw receiving members threadably mounted on said screws for relative rotation between said screws and said screw receiving members. The screw receiving members may be connected to the base whereby upon said relative rotation, the base is moved between the said first and second positions. Preferably the screws are fixed and said screw receiving members are rotatable on the screws. The arrangement may also comprise drive means to rotate the screw receiving members to move the base member between the first and second positions, the base member being connected to the screw receiving members. The drive means may comprise a motor mounted on the base member.

Vibration means may be provided to vibrate the base member when the base member is in the second position. The vibration means may comprise at least one motor mounted eccentrically on the base member. Preferably, the vibration means comprises two motors.

The weighing apparatus may also be provided with stop means to stop the drive means when the base member reaches the second position. Preferably, the stop means are adjustable along the screws so that said second position can be at any desired point above the first position. Preferably, the stop means comprise limit switches.

The support means may comprise a frame to carry the article to be weighed.

Preferably the frame comprises a ground engaging portion and an article carrying portion. The article carrying portion may be connected to the ground engaging portion by load cells, The article carrying portion is preferably in the form of a triangle and one of said load cells may be provided at each apex of the triangle.

The frame may also comprise connecting members to connect the article to be weighed to the triangular portion. Preferably, each connecting member is in the form of a T-shaped member comprising a lower substantially horizontal member and a substantially vertical member extending upwardly from a centre region of the lower member. The lower member may be provided with securing means to secure thereto the article to be weighed. The securing means may comprise hook means provided on each end of the lower member.

Preferably, the frame provides limited movement for the article.

The weighing apparatus may also comprise filling means to fill the article.

Gas supply means may also be provided such that, where the article to be weighed is a bag having a liner, the liner can be inflated. The gas supply means may comprise a fan or other gas moving apparatus.

An embodiment of the invention will now be described by way of example only, with reference to the accompanying drawings.

Figure 1:
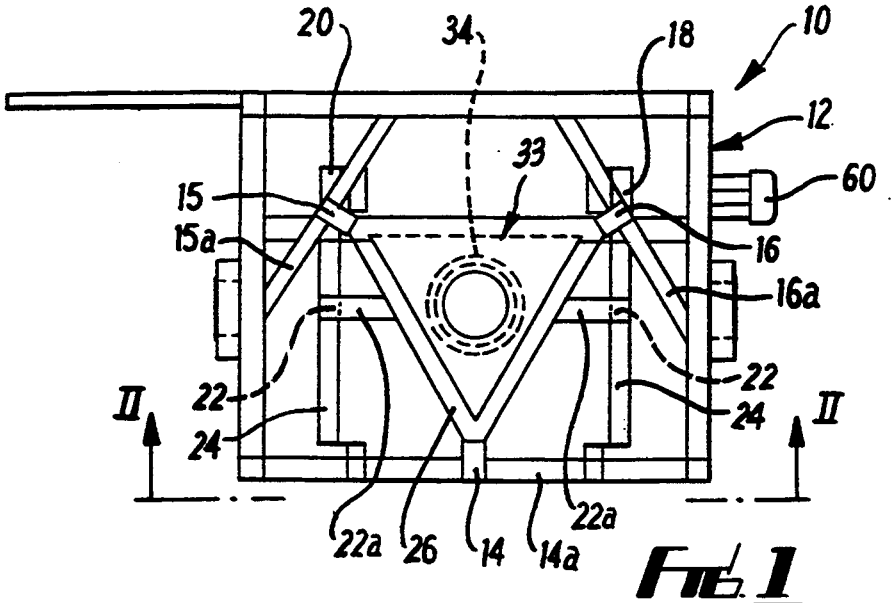
FIG. 1 is a plan view of weighing apparatus.

Referring to the drawings, a weighing apparatus 10 is shown which is suitable for use in filling a large bag (for example, a bag of 1 tonne capacity) with a material. The apparatus 10 comprises a support means 12 comprising a frame having a ground engaging portion 17 and an article carrying portion in the form of a triangle 26 and first and second T-shaped members 18,20. The T-shaped members 18,20 each comprise a substantially vertical member 22 extending from a centre region of a lower horizontal member 24.

The T-shaped members 18,20 are connected to the triangle 26 by the vertical members 22 via bars **22*a***.

The horizontal members 24 are provided with hook means in the form of hooks 28 at each end thereof which a bag 30 can be attached by means of loops The T-shaped members 18,20 are adapted to provide pivotal movement for the bag 30.

Three shear beam load cells 14,15,16 are each connected to one of the apices of the triangular portion 26, and are mounted on beams **14*a*,15*a* and 16*a***.

The triangle 26 is attached to feed means comprising a neck support ring 34 to hold the neck of the bag 30, and a nozzle 38 which is disposed in the neck 36 of the bag 30 to facilitate filling of the bag 30.

The shear beam load cells 14,15,16 are in the form of bars whereby the strain of the weight of the bag 30 on the bars 40,42 is directly proportional to the force applied thereto. In view of this, the weight of the material in the bag 30, can be ascertained by measuring the amount of strain on the bars, as would be appreciated by a person skilled in the art.

Figure 2:
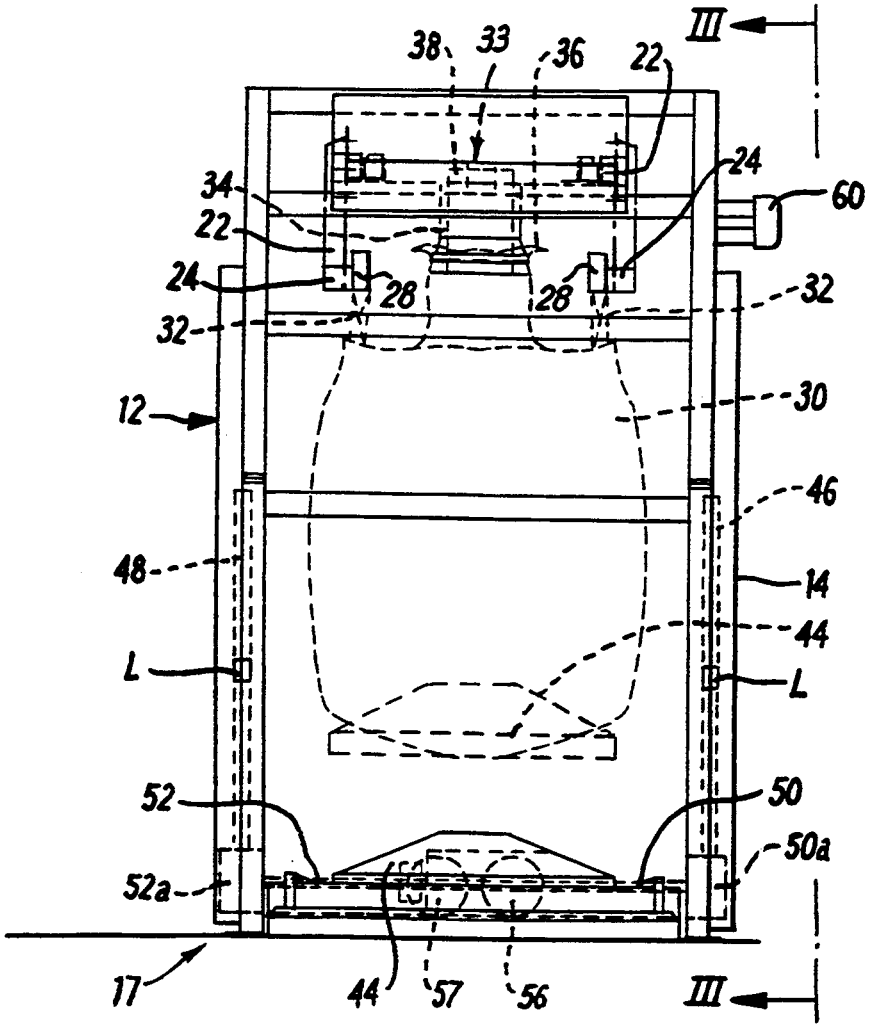
FIG. 2 is a view along the lines II—II of FIG. 1.
Figure 3:
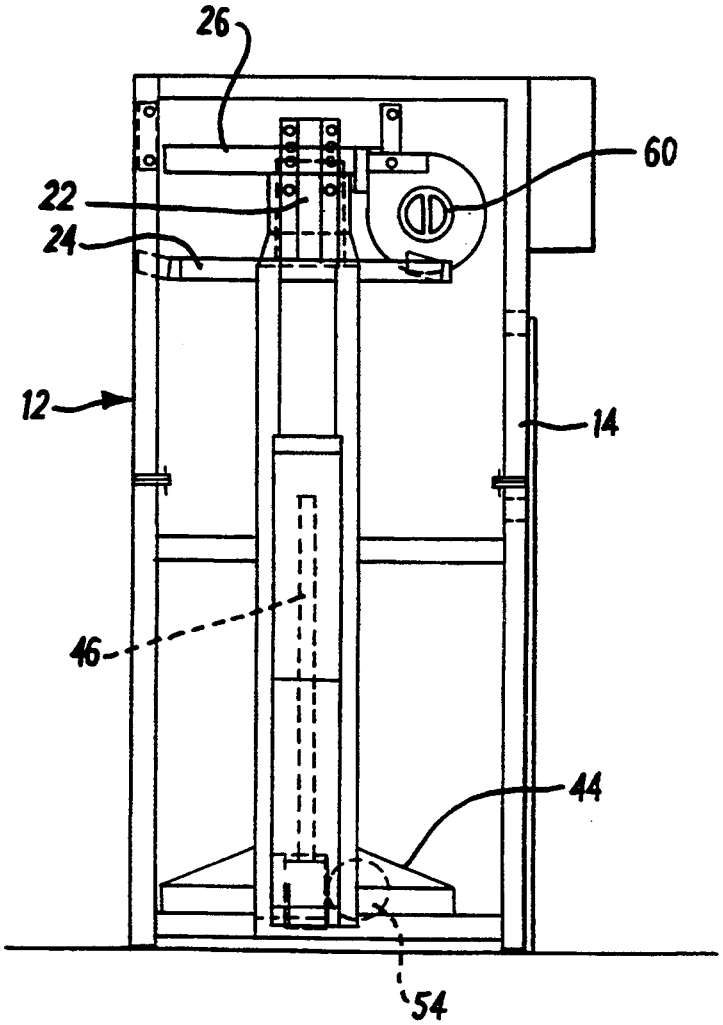
FIG. 3 is a view along the lines III—III in FIG. 2.

The weighing apparatus 10 also comprises a base member in the form of a platform 44 having sloping sides which is movable up and down between a first position and a second position, the second position being shown in phantom in FIG. 2. When the platform 44 is in the second position it contacts the bottom of the bag 30 when the bag 30 is being filled. First and second screws 46,48 are provided at either side of the support 12. The platform 44 is connected to the screws 46,48 by appropriate linkages 50,52 to collars **50*a*,52*a* threadably mounted on the screws 46,48. The platform 44 is also provided with a drive motor 54 (see FIG. 3) to rotate the collars 50*a*,52*a* thereby to drive the platform 44 upwards or downwards as desired. Eccentrically mounted motors 56,57 are provided to vibrate the platform 44, thereby to ensure that the bag is completely filled with the material. Thus, the position of the platform 44** can be infinitely varied between its lowermost and uppermost positions.

Limit switches L are adjustably mounted on or adjacent the screws 48 to detect and signal to the motor 54 when the platform reaches the desired bag supporting position. The position of the limit switches can be altered when bags of different sizes are being filled.

In operation, the loops 32 are hooked over the hooks 28 on the horizontal members 24. The neck portion 36 is then secured to the neck support ring 34 and the nozzle 38. The platform 44 is then raised by rotating the collars **50*a*,52*a* in the appropriate directions until the platform 44 contacts the bottom of the bag 30. The motors 54,56,57 are provided on the platform 44 and are raised and lowered with the platform 44**.

When filling begins, the motors 56,57 operates to vibrate the platform 44 and thereby the bag, to ensure that the bag is filled. As the bag 30 fills up with material, the load on the strain gauges increases and thereby, the weight in the bag 30 can be ascertained. It is necessary at intervals to reweigh the bag 30. During such reweighing the platform 44 is lowered. When the bag 30 is filled to its desired weight, the filling is stopped and the bag 30 is removed.

Also, lowering the platform 44 during filling of the bag 30, enables the bag 30 to stretch to increase its size and also to remove any creases. In this way, the capacity of the bag 30 is increased.

A fan 60 may be provided for use when the bag has a liner. In use, the fan 60 blow air into the liner of the bag to expand it thereby to facilitate filling of the bag 30.

Various modifications can be made without departing from the scope of the invention, for example the support 12 can be any suitable shape, not necessarily that as shown. Also, the T-shaped members and the strain gauges need not be in the position as shown; they could be provided at other places about triangle 26. The form for inflating the bag may be replaced by other suitable bag moving apparatus. For example, a fan may not be suitable when the bag is inflated by an inert gas, for example, nitrogen.

I claim:

1. Weighing apparatus comprising:

support means to support an article to be weighed;

a base member movable relative to the support means from a first position spaced from the bottom of the article to a second position in contact with the bottom of the article;

first and second screws fixedly mounted on the support means, and first and second screw receiving members threadably mounted on said first and second screws respectively, said screw receiving members being connected to the base member whereby, upon rotation of said screw receiving members relative to said screws, the base member can be moved between said first and second positions.

2. Weighing apparatus according to claim 1, wherein the screw threaded arrangement comprises first and second screws mounted on the support means at either side of the article to be weighed.

3. Weighing apparatus according to claim 1, wherein the screw threaded arrangement also comprises drive means to rotate the screw receiving members to move the base member between the first and second positions.

4. Weighing apparatus according to claim 3, wherein the drive means comprises a motor mounted on the base member.

5. Weighing apparatus according to claim 3, comprising stop means to stop the drive means when the base member reaches the second position.

6. Weighing apparatus according to claim 5, wherein the stop means are adjustable along the screws so that said second position can be at any desired point above the first position.

7. Weighing apparatus according to claim 6, wherein the stop means comprise limit switches.

8. Weighing apparatus according to claim 1, comprising vibration means to vibrate the base member when the base member is in the second position.

9. Weighing apparatus according to claim 8, wherein the vibration means comprises at least one motor mounted eccentrically on the base member.

10. Weighing apparatus according to claim 9, wherein the vibration means comprises two motors.

11. Weighing apparatus according to claim 1, wherein the support means comprises a frame to carry the article to be weighed.

12. Weighing apparatus according to claim 11, wherein the frame comprises an article carrying portion connected to a ground engaging portion, the apparatus also comprising load cells to connect the article carrying portion to the ground engaging portion.

13. Weighing apparatus according to claim 12, wherein the article carrying portion is in the form of a triangle and one of said load cells in provided at each apex of said triangle.

14. Weighing apparatus according to claim 13, wherein the load cells comprise shear beam load cells.

15. Weighing apparatus according to claim 12, wherein the frame also comprises connecting members to connect the article to be weighed to the triangular portion, each connection member being in the form of a T-shaped member comprising a lower substantially horizontal member and a substantially vertical member extending upwardly from a centre region of the lower member.

16. Weighing apparatus according to claim 15, wherein the lower member is provided with securing means to secure thereto the article to be weighed.

17. Weighing apparatus according to claim 16, wherein the securing means comprises hook means provided on each end of the lower member.

18. Weighing apparatus according to claim 1, comprising filling means to fill the article.

19. Weighing apparatus according to claim 1, wherein air supply means is provided such that, where the article to be weighed is a bag having a liner, the liner can be inflated, the air supply means being in the form of a fan or gas mover.

20. Weighing apparatus comprising:

support means for supporting an article to be weighed;

a base member movable vertically relative to said support member between a position spaced below an article to be weighed and a position supporting the article to be weighed;

a plurality of vertically extending screws mounted on said support means;

a screw receiving member threaded on each of said screws, each of said screw receiving members being connected with said base member for vertical movement therewith; and means for providing relative rotation between said screws and said screw receiving members to threadably move said screw receiving members along said screws and thereby affect vertical movement of said base member.

21. The apparatus of claim 20 wherein said screws extend both above and below said base member and said means for providing relative rotation comprises at least one drive motor mounted on said base member for providing rotation of said screw receiving members relative to said screws.

* * * * *